US008801098B1

(12) United States Patent
Richards

(10) Patent No.: US 8,801,098 B1
(45) **Date of Patent: *Aug. 12, 2014**

(54) MOTORIZED CHAIR SYSTEM FOR INDIVIDUALS WITH LIMITED MOTOR FUNCTION

(71) Applicant: Cheryl S. Richards, Tucson, AZ (US)

(72) Inventor: Cheryl S. Richards, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/915,180

(22) Filed: Jun. 11, 2013

Related U.S. Application Data

(63) Continuation-in-part of application No. 13/107,884, filed on May 14, 2011, now Pat. No. 8,485,602.

(60) Provisional application No. 61/334,916, filed on May 14, 2010.

(51) Int. Cl.
*A47C 3/029* (2006.01)

(52) U.S. Cl.
USPC ..... 297/260.2; 297/270.1; 297/270.5; 5/109

(58) Field of Classification Search
USPC ..... 297/260.2, 270.1, 270.5; 5/108, 109
See application file for complete search history.

(56) References Cited

U.S. PATENT DOCUMENTS

| | | | | | |
|---|---|---|---|---|---|
| 188,120 | A | * | 3/1877 | French et al. | 297/131 X |
| 248,753 | A | * | 10/1881 | Huston | 297/270.1 |
| 3,019,052 | A | | 1/1962 | Zawadzki | |
| 4,775,184 | A | | 10/1988 | Larkin | |
| 4,822,030 | A | * | 4/1989 | Cone | 297/5 |
| 5,368,361 | A | | 11/1994 | Wen-Ming | |
| 6,774,589 | B2 | | 8/2004 | Sato et al. | |

* cited by examiner

*Primary Examiner* — Anthony D Barfield

(57) ABSTRACT

A motorized chair system for promoting movement, balance, and vestibular processing and integration. The chair system features a chair component comprising a back support portion disposed atop a seat portion. The back support portion is formed from a first side panel, a middle panel, and a second side panel connected together, wherein rigid intersections are formed between the side panels and middle panel. A rocking component is positioned below the chair component. The rocking component is shaped to allow the chair component to rock. A motor system is operatively connected to a piston, the piston being mounted to a ground surface. The motor system functions to automatically rock the chair component forwardly and backwardly by pushing against the piston to pivot the system in a forward motion. A control button is operatively connected to the motor system. The control button functions to turn the motor system on and off.

15 Claims, 11 Drawing Sheets

MOTORIZED CHAIR SYSTEM FOR INDIVIDUALS WITH LIMITED MOTOR FUNCTION

CROSS REFERENCE

This application is a continuation-in-part of U.S. patent application Ser. No. 13/107,884 filed May 14, 2011, U.S. Pat. No. 8,485,602, which claims priority to U.S. provisional application Ser. No. 61/334,916 filed May 14, 2010, the specifications of which are incorporated herein by reference in their entirety.

FIELD OF THE INVENTION

The present invention is directed to motorized chairs and motorized seating equipment, more particularly to a motorized rocking chair that provides controlled motion to an individual.

BACKGROUND OF THE INVENTION

The present invention features a motorized chair system, e.g., a motorized rocking chair, which provides controlled motion to an individual. The motorized chair system of the present invention may be particularly useful for individuals with limited motor functions. The motorized chair system may help promote better movement, balance, equilibrium, and vestibular processing and integration.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a motorized chair system (100), e.g., a motorized rocking chair, which provides controlled motion to an individual. The motorized chair system (100) of the present invention may be particularly useful for individuals with limited motor functions. The motorized chair system (100) may help promote better movement, balance, equilibrium, and vestibular processing and integration. In some embodiments, the motorized chair system (100) comprises a chair component (105) comprising a back support portion (120) disposed atop a seat portion (110), the back support portion (120) is formed from a first side panel (111), a middle panel (113), and a second side panel (112) connected together wherein the middle panel (113) is sandwiched between the first side panel (111) and the second side panel (112), wherein a first rigid intersection (114) is formed between the first side panel (111) and the middle panel (113) and a second rigid intersection (115) is formed between the second side panel (112) and the middle panel (113); a leg divider shaft (130) disposed on the seat portion (110) near or at a front surface (118), the leg divider shaft (130) functions to separate a user's legs when seated atop the seat portion (110); a rocking component (205), the chair component (105) is mounted atop the rocking component (205), the rocking component (205) is shaped to allow the chair component (105) to rock forwardly and backwardly; a wheel system (240) disposed on the rocking component (250) to allow transport of the system (100); a motor system (310) disposed on the rocking component (205) and operatively connected to a piston (320), the piston (320) being mounted to a ground surface, the motor system (310) functions to automatically rock the chair component (105) forwardly and backwardly by pushing against the piston (320) to pivot the system (100) in a forward motion; and a control button (380) operatively connected to the motor system (310), the control button (380) functions to turn the motor system (310) on and off, the control button (380) is mounted to the back support portion via a temporary attachment means (382), the temporary attachment means (382) allowing a user to choose a position of the control button (380).

In some embodiments, the wheel system (240) comprises (a) a first wheel (250*a*) disposed on the rocking component (205) at or near a front end (211) of the first rocker (210) or at or near a front end of a first base side (280*a*) of a chair base (280); (b) a second wheel (250*b*) disposed on the rocking component (205) at or near a back end (212) of the first rocker (210) or at or near a back end of the first base side (280*a*) of the chair base (280); (c) a third wheel disposed on the rocking component (205) at or near a front end (221) of the second rocker (220) or at or near a front end of a second base side (280*b*) of the chair base (280); and (d) a fourth wheel disposed on the rocking component (205) at or near a back end (222) of the second rocker (220) or at or near a back end of the second base side (280*b*) of the chair base (280).

In some embodiments, the wheels (250) are attached via mounting brackets (260). In some embodiments, the wheels (250) of the wheel system (240) can be locked to temporarily prevent transport of the system (100). In some embodiments, the wheels (250) can be lowered to contact a ground surface when the system (100) is to be moved, and the wheels (250) cab be raised off the ground surface when the system (100) is to be immobilized. In some embodiments, each wheel (250) is connected to a pedal (290), the pedal (290) is pivotally attached to a pivot bracket (292) disposed on the rocking component (205).

In some embodiments, the system further comprises straps (140) disposed on the chair component (105) for securing the user in the chair component (105). In some embodiments, the straps (140) are disposed on the back support portion (120). In some embodiments, the rocking component (205) comprises a first rocker (210) disposed on a first side and a second rocker (220) disposed on a second side.

In some embodiments, the motor system (310) is operatively connected to a control box (340). In some embodiments, the control box (340) allows for manipulation of rocking speed. In some embodiments, the control box (340) allows for manipulation of frequency of rocking. In some embodiments, the motor system (310) is operatively connected to a power source. In some embodiments, the power source is a battery or an electrical outlet. In some embodiments, the motor system (310) is operatively connectable to an electrical outlet via a power cord (350).

In some embodiments, the temporary attachment means (382) is a hook-and-loop fastener mechanism, a magnet mechanism, a snap mechanism, or a combination thereof. In some embodiments, the temporary attachment means (382) is be disposed on the first side panel (111) or the second side panel (112). In some embodiments, the temporary attachment means (382) is disposed along the height of the first side panel (111) or second side panel (112) (e.g., extending from near the top edge of the side panel to near the bottom edge of the side panel, as shown in FIG. 1), allowing the control button (380) to be placed anywhere (or in various places) along the height of the panel. This allows for the system to accommodate the growth of the user. In some embodiments, the control button (380) is further operatively connected to the control box (340).

In some embodiments, the system further comprises a footrest (150) disposed on the rocking component (205) below the seat portion (110) of the chair component (105). In some embodiments, the footrest (150) comprises straps for securing the individual's feet on the footrest (150).

In some embodiments, the first side panel (111), the middle panel (113), and the second side panel (112) are each flat panels. A first angle (301) is formed between the first side panel (111) and the middle panel (113) (the front surfaces of the respective panels). A second angle (302) is formed between the second side panel (112) and the middle panel (113) (the front surfaces of the respective panels).

In some embodiments, the first angle (301) is between about 90 to 179 degrees. In some embodiments, the first angle (301) is between about 25 to 50 degrees. In some embodiments, the first angle (301) is between about 30 to 60 degrees. In some embodiments, the first angle (301) is between about 35 to 60 degrees. In some embodiments, the first angle (301) is between about 40 to 60 degrees. In some embodiments, the first angle (301) is between about 45 to 60 degrees. In some embodiments, the first angle (301) is between about 50 to 70 degrees. In some embodiments, the first angle (301) is between about 60 to 80 degrees. In some embodiments, the first angle (301) is between about 70 to 90 degrees. In some embodiments, the first angle (301) is between about 90 to 100 degrees. In some embodiments, the first angle (301) is between about 100 to 110 degrees. In some embodiments, the first angle (301) is between about 110 to 120 degrees. In some embodiments, the first angle (301) is between about 100 to 120 degrees. In some embodiments, the first angle (301) is between about 110 to 130 degrees. In some embodiments, the first angle (301) is between about 120 to 140 degrees. In some embodiments, the first angle (301) is between about 130 to 150 degrees. In some embodiments, the first angle (301) is between about 140 to 160 degrees. In some embodiments, the first angle (301) is between about 150 to 170 degrees. In some embodiments, the first angle (301) is between about 150 to 179 degrees.

In some embodiments, the second angle (302) is between about 90 to 179 degrees. In some embodiments, the second angle (302) is between about 25 to 50 degrees. In some embodiments, the second angle (302) is between about 30 to 60 degrees. In some embodiments, the second angle (302) is between about 35 to 60 degrees. In some embodiments, the second angle (302) is between about 40 to 60 degrees. In some embodiments, the second angle (302) is between about 45 to 60 degrees. In some embodiments, the second angle (302) is between about 50 to 70 degrees. In some embodiments, the second angle (302) is between about 60 to 80 degrees. In some embodiments, the second angle (302) is between about 70 to 90 degrees. In some embodiments, the second angle (302) is between about 90 to 100 degrees. In some embodiments, the second angle (302) is between about 100 to 110 degrees. In some embodiments, the second angle (302) is between about 110 to 120 degrees. In some embodiments, the second angle (302) is between about 100 to 120 degrees. In some embodiments, the second angle (302) is between about 110 to 130 degrees. In some embodiments, the second angle (302) is between about 120 to 140 degrees. In some embodiments, the second angle (302) is between about 130 to 150 degrees. In some embodiments, the second angle (302) is between about 140 to 160 degrees. In some embodiments, the second angle (302) is between about 150 to 170 degrees. In some embodiments, the second angle (302) is between about 150 to 179 degrees.

DESCRIPTION OF PREFERRED EMBODIMENTS

Referring now to FIG. 1-9, the present invention features a motorized chair system (100), e.g., a motorized rocking chair, which provides controlled motion to an individual. The motorized chair system (100) of the present invention may be particularly useful for individuals with limited motor functions. The motorized chair system (100) may help promote better movement, balance, equilibrium, and vestibular processing and integration. For example, the system (100) can help an individual develop gross motor arm control. In some embodiments, the motorized chair system (100) helps improve cognizance, head control, eye contact, imitative behaviors, direction-following skills, and visual tracking skills. The system (100) may be particularly soothing to users. Additional benefits may include but are not limited to: provides kinesthesia/sensory system benefits (e.g., provides information from muscles, joints, ligaments), provides internal awareness about body parts to allow user to perform tasks with coordination, provides motor planning (e.g., ability to organize, plan, and execute new or unplanned motor tasks), improves tactile/movement/kinesthetic-proprioceptive processing, increases body awareness, facilitates progress in motor skills, increases independence, teaches cause and effect relationships, teaches how to focus on a purposeful action that the user can control and repeat (e.g. via a switch), facilitates learning, leads to better self-help, communication, and leisure skills, etc.

Figure 1:
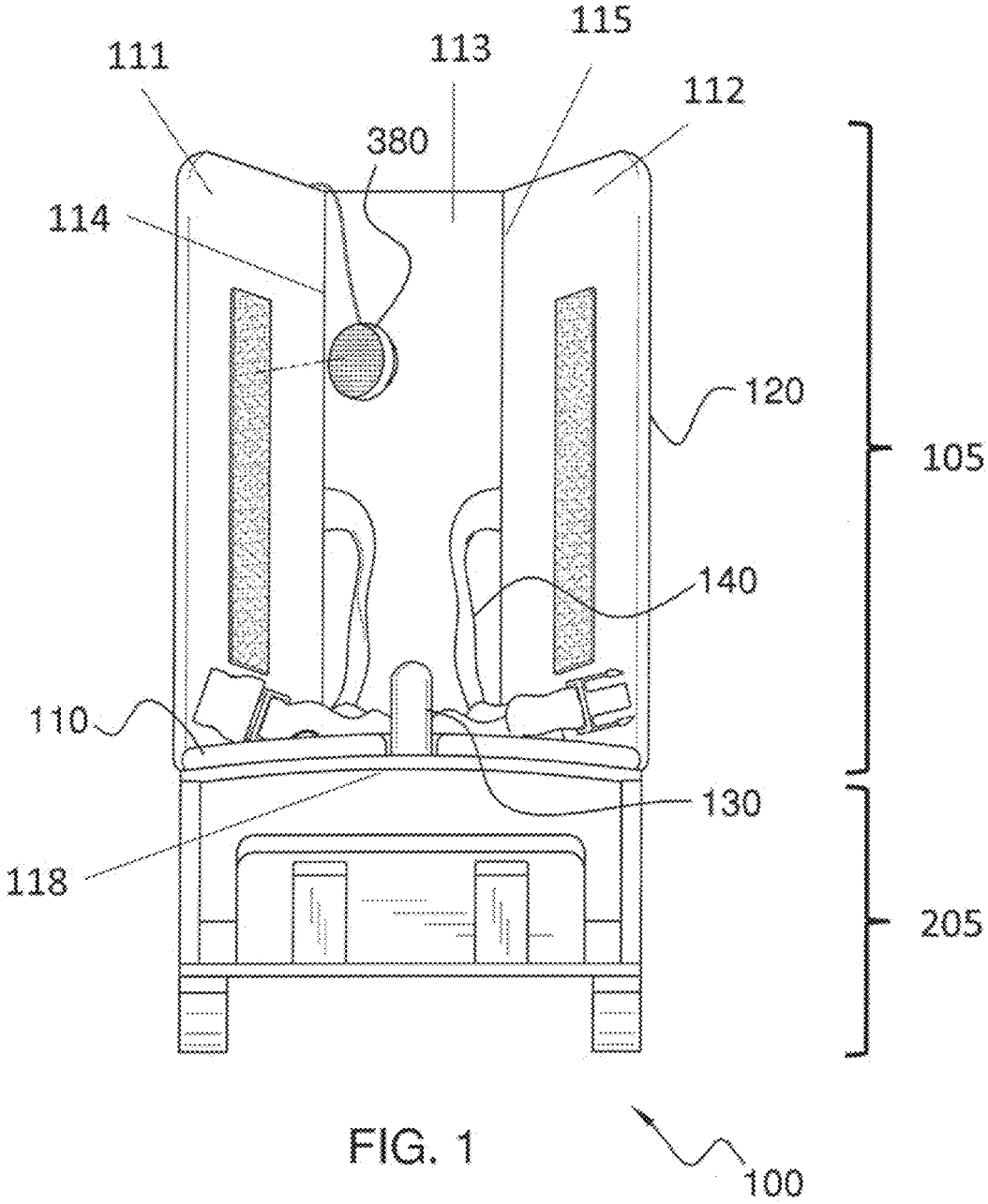
FIG. 1 is a front view of the motorized chair system of the present invention.
Figure 2:
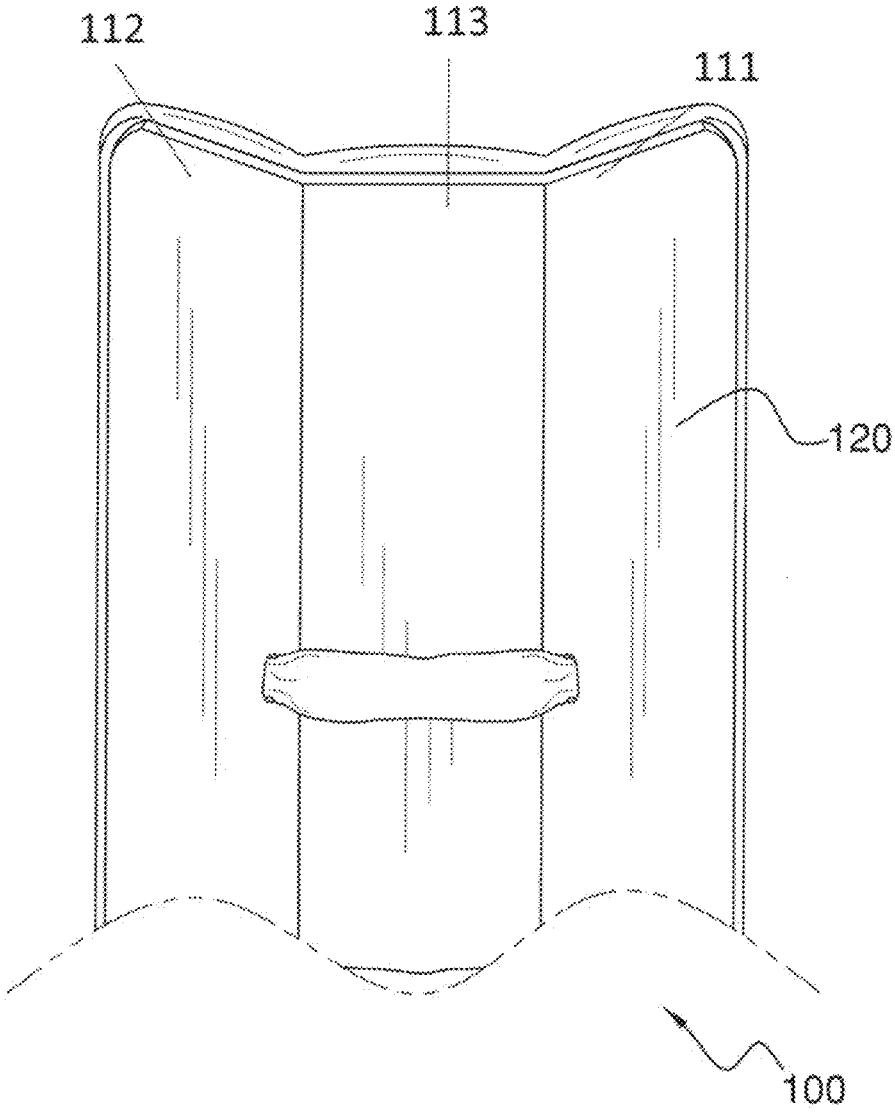
FIG. 2 is a back view of the system of FIG. 1.

The motorized chair system (100) of the present invention comprises a chair component (105). As shown in FIG. 1, the chair component (105) comprises a seat portion (110) and a generally curved back support portion (120). A leg divider shaft (130) (e.g., an abductor) is disposed on the seat portion (110), functioning to separate the user's legs (e.g., help keep the legs from crossing). Straps (140) are disposed on the chair component (105) (e.g., on the back support portion (120)) for securing the user in the chair component (105). The chair component (105) may be constructed in a variety of materials, for example the chair component (105) may comprise various materials (e.g., padding, etc.) for providing comfort to a user. FIG. 2 shows a back view of the chair component (105).

Figure 3:
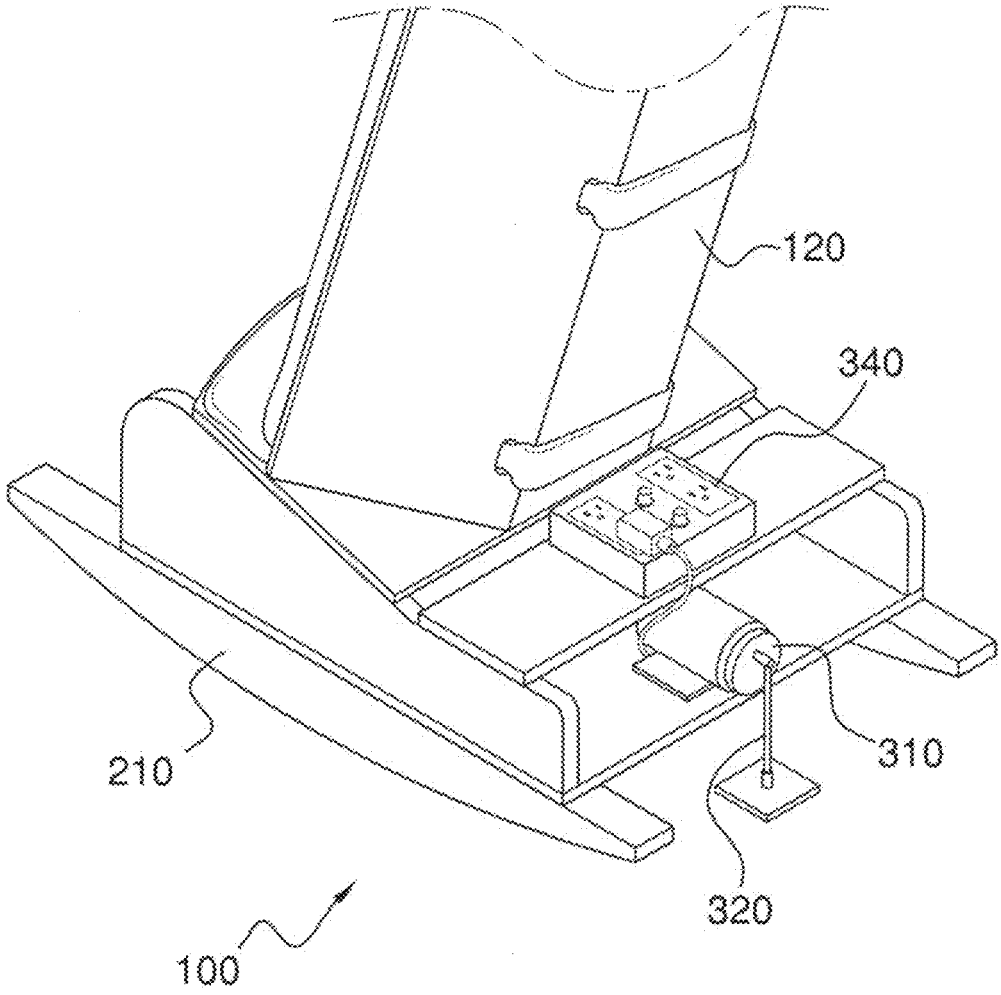
FIG. 3 is a back perspective view of the system of FIG. 1.
Figure 5:
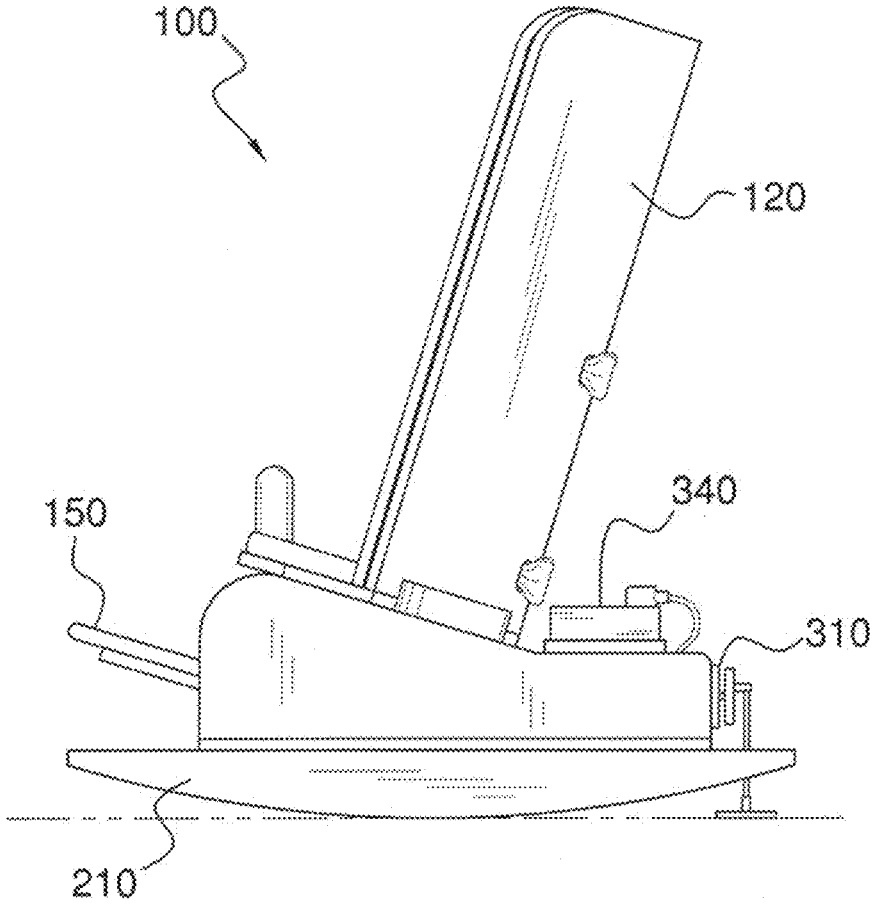
FIG. 5 is a side view of the system of FIG. 1.

Referring now to FIG. 3 and FIG. 5, the chair component (105) is mounted atop a rocking component (205). For example, in some embodiments, the rocking component (205) comprises a first rocker (210) disposed on a first side and a second rocker (220) disposed on a second side. The rocking component (205) allows the system (100) of the present invention to rock like a standard rocking chair, which is well known to one of ordinary skill in the art. As shown in FIG. 3, the chair component (105) is positioned at the front portion of the rocking component (205).

Figure 7:
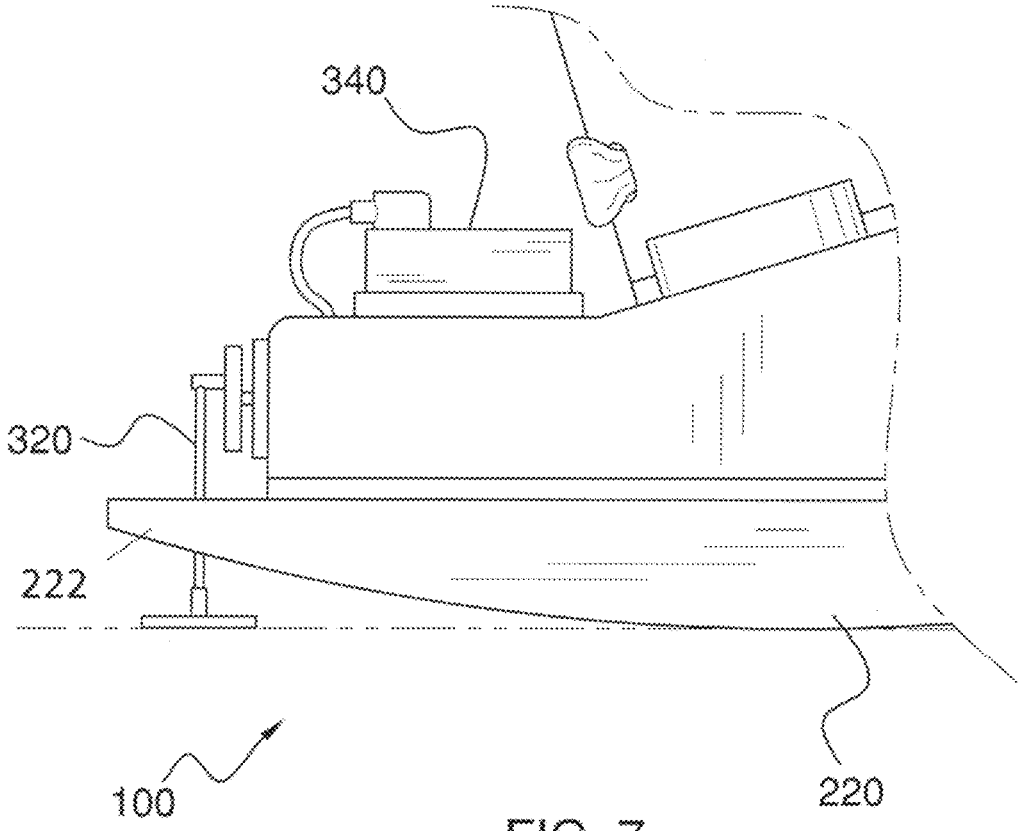
FIG. 7 is a side detailed view of the system of FIG. 6.

A motor system (310) (e.g., 0.07/0.09 TE) is disposed on the back portion of the rocking component (205). The motor system (310) functions to automatically rock the system (100) of the present invention. As shown in FIG. 3 and FIG. 7, the motor system (310) comprises a piston (320) for mounting on a ground surface. The motor system (310) pushes against the piston (320) to pivot the system in a forward direction (e.g., rocking motion).

Figure 4:
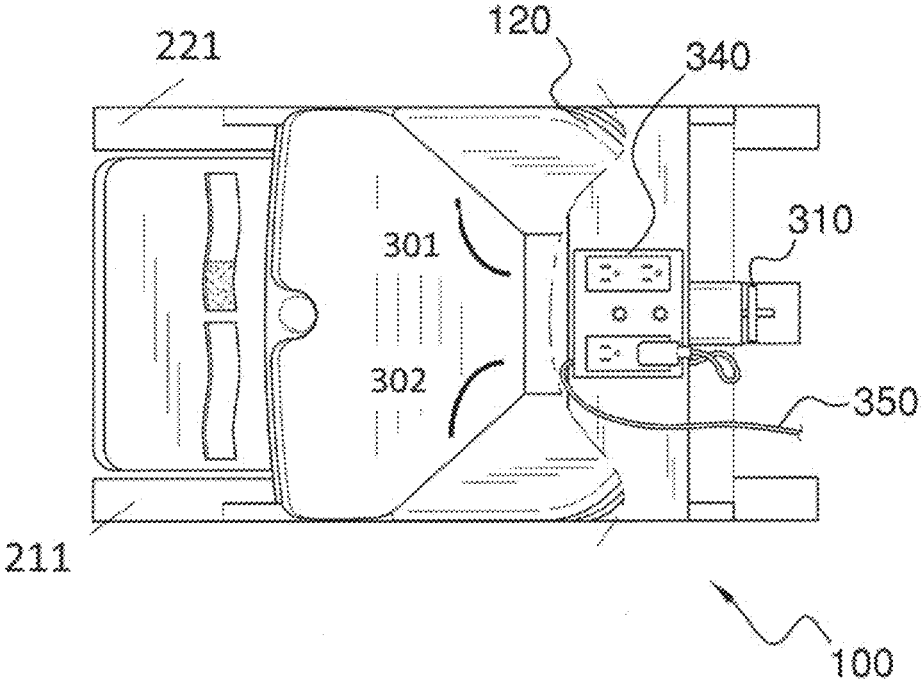
FIG. 4 is a top view of the system of FIG. 1.

Referring now to FIG. 4, the motor system (310) is operatively connected to a control box (340). The control box (340) allows manipulation of the motor system (310), for example rocking speed and frequency can be manipulated. The motor system (310) is operatively connected to a power source. In some embodiments, the power source is a battery (e.g., marine battery) or an electrical outlet. In some embodiments, the motor system (310) is operatively connectable to an electrical outlet via a power cord (350). In some embodiments, the motorized chair system (100) of the present invention further comprises a means of plugging in other devices (e.g., other devices with buttons), so a user can practice turning devices on and off, for example via the push buttons of the devices.

Figure 6:
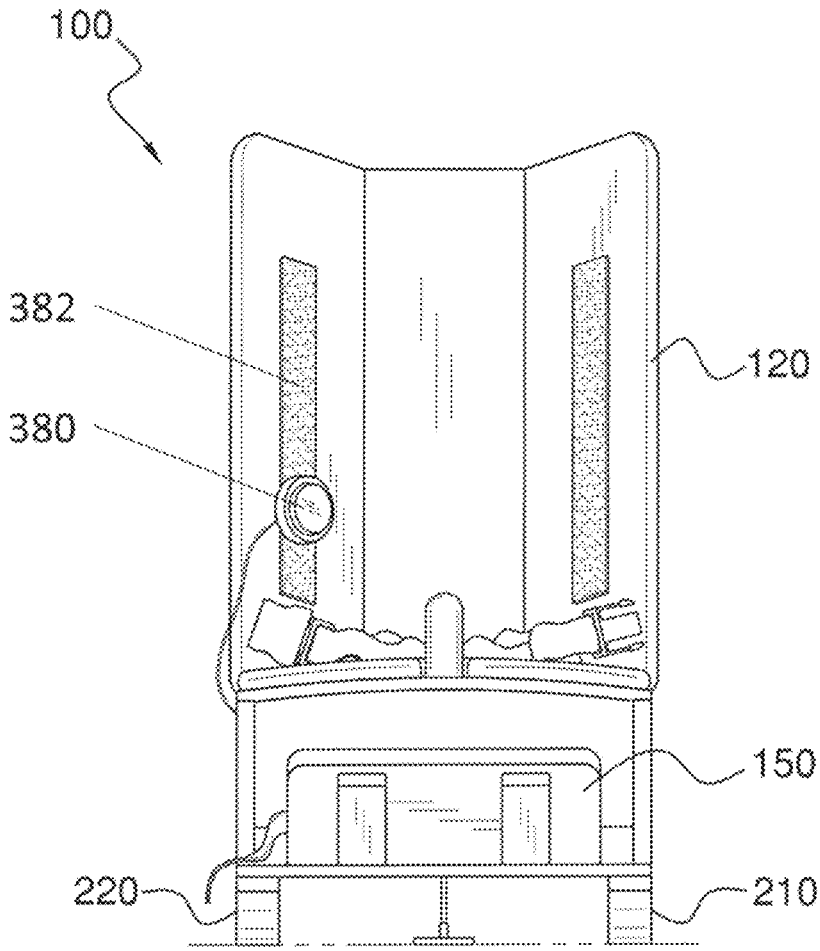
FIG. 6 is a front view of the motorized chair system of the present invention.

As shown in FIG. 5 and FIG. 6, a footrest (150) is disposed on the rocking component (205) below the seat portion (110) of the chair component (105). The footrest (150) may provide comfort to the individual. Straps may also be disposed on the footrest (150) for securing the individual's feet, however the use of the straps is optional.

A user can control the system (100) of the present invention, allowing him/her to determine when he/she wants to engage in the controlled motion (e.g., the user can stop the system if he/she is tired). The system (100) comprises a control button (380) (e.g., see FIG. 1) operatively connected to the control box (340) and/or motor system (310). In some embodiments, the control button (380) is mounted to the system via a temporary attachment means (e.g., hook-and-loop fasteners). In some embodiments, a user may activate the control button (380) by gross motor arm movement. Without wishing to limit the present invention to any theory or mechanism, it is believed that such a control button (380) encourages purposeful movement and refinement of basic movement skills. The control button (380) may teach cause and effect relationships, how to use an object/switch, or how to pay attention. The control button (380) may provide various sensory experiences. The control button (380) may teach how to focus on an action he/she can control and repeat.

As an example, in some embodiments, the system (100) comprises a fractional horse power DC motor (e.g., 0.07-0.09 HP), optionally with a speed controller. In some embodiments, the shaft output may be about ¼" to ¾" long. In some embodiments, the input may be about 115V, which may be converted to about 24V with speed control. The system (100) may comprise a timer with an on/off feature and time settings, for example for about 5 minutes to about 60 minutes. The system (100) may comprise a remote with an on/off switch feature and/or a momentary switch to start/stop. The motor may be obtained from a variety of sources, e.g., Mobility-Works Commercial. The present invention is not limited to the aforementioned examples and components.

As previously discussed, the rocking component (205) comprises a first rocker (210) and a second rocker (220). The first rocker (210) has a front end (211) and a back end (212), and the second rocker (220) has a front end (221) and a back end (222). In some embodiments, the seat portion (110) of the chair component (105) is mounted atop a chair base (280), the chair base (280) being mounted atop the first rocker (210) and the second rocker (220). For example, as shown in FIG. 8, the chair base (280) comprises a first base side (280*a*) mounted atop the first rocker (210) and a second base side (280*b*) mounted atop the second rocker (220). The seat portion (110) is mounted atop the first base side (280*a*) and second base side (280*b*) of the chair base (280).

The system (100) of the present invention may further comprise a wheel system (240), e.g., wheels (250), for enabling movement and relocation of the chair. The wheels (250) may be caster wheels, rocker caster wheels, or any other appropriate type of wheels. In some embodiments, the wheels (250) are arranged on the sides of the system (100), e.g., on or around the first rocker (210) and on or around the second rocker (220).

For example, in some embodiments, a first wheel (250*a*) is disposed on the first rocker (210) at or near the front end (211) of the first rocker (210). In some embodiments, the first wheel (250*a*) is disposed on the first rocker (210) at or near the front end of the first base side (280*a*) of the chair base (280). In some embodiments, a second wheel (250*b*) is disposed on the first rocker (210) at or near the back end (212) of the first rocker (210). In some embodiments, the second wheel (250*b*) is disposed on the first rocker (210) at or near the back end of the first base side (280*a*) of the chair base (280). In some embodiments, a third wheel is disposed on the second rocker (220) at or near the front end (221) of the second rocker (220). In some embodiments, the third wheel is disposed on the second rocker (220) at or near the front end of the second base side (280*b*) of the chair base (280). In some embodiments, a fourth wheel is disposed on the second rocker (220) at or near the back end (222) of the second rocker (220). In some embodiments, the fourth wheel is disposed on the second rocker (220) at or near the back end of the second base side (280*b*) of the chair base (280).

In some embodiments, the wheels (250) are attached to the rockers (210, 220) and/or base sides (280*a*, 280*b*) via mounting brackets (260).

In some embodiments, the mounting bracket (260) of the first wheel (250*a*) is at a point about ¾ inch from the front end of the first base side (280*a*) of the chair base (280). In some embodiments, the bottom edge of the mounting bracket (260) for the first wheel (250*a*) is about level with the bottom edge of the first rocker (210). In some embodiments, the mounting bracket (260) of the third wheel is at a point about ¾ inch from the front end of the second base side (280*b*) of the chair base (280). In some embodiments, the bottom edge of the mounting bracket (260) for the third wheel is about level with the bottom edge of the second rocker (220). In some embodiments, the mounting bracket (260) of the second wheel (250*b*) is located about 5⅛ inch from the back end of the first base side (280*a*) of the chair base (280). In some embodiments, the bottom edge of the mounting bracket (260) for the second wheel (250*b*) is about 1.25 inches above the bottom edge of the first rocker (210). In some embodiments, the mounting bracket (260) of the fourth wheel is located about 5⅛ inch from the back end of the second base side (280*b*) of the chair base (280). In some embodiments, the bottom edge of the mounting bracket (260) for the fourth wheel is about 1.25 inches above the bottom edge of the second rocker (220).

The present invention is not limited to the aforementioned wheel configuration. For example, the present invention may feature three wheels distributed on the bottom of the chair, or more than two pairs of wheels, etc. Rocker caster wheels are well known to one of ordinary skill in the art (see, for example, www.rockler.com).

Figure 8A:
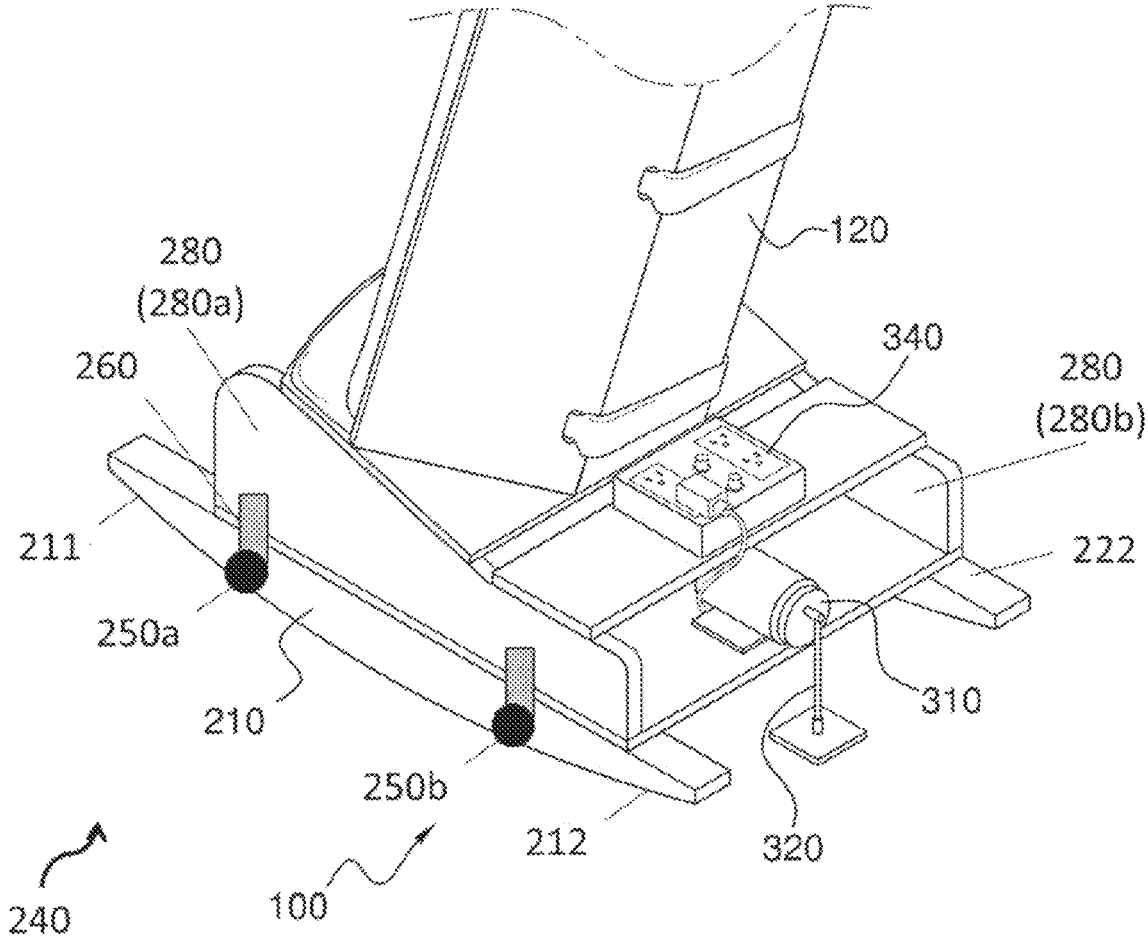
FIG. 8A is a back perspective view of the system of the present invention, wherein the wheels are raised so as to prevent movement of the system via the wheels.
Figure 8B:
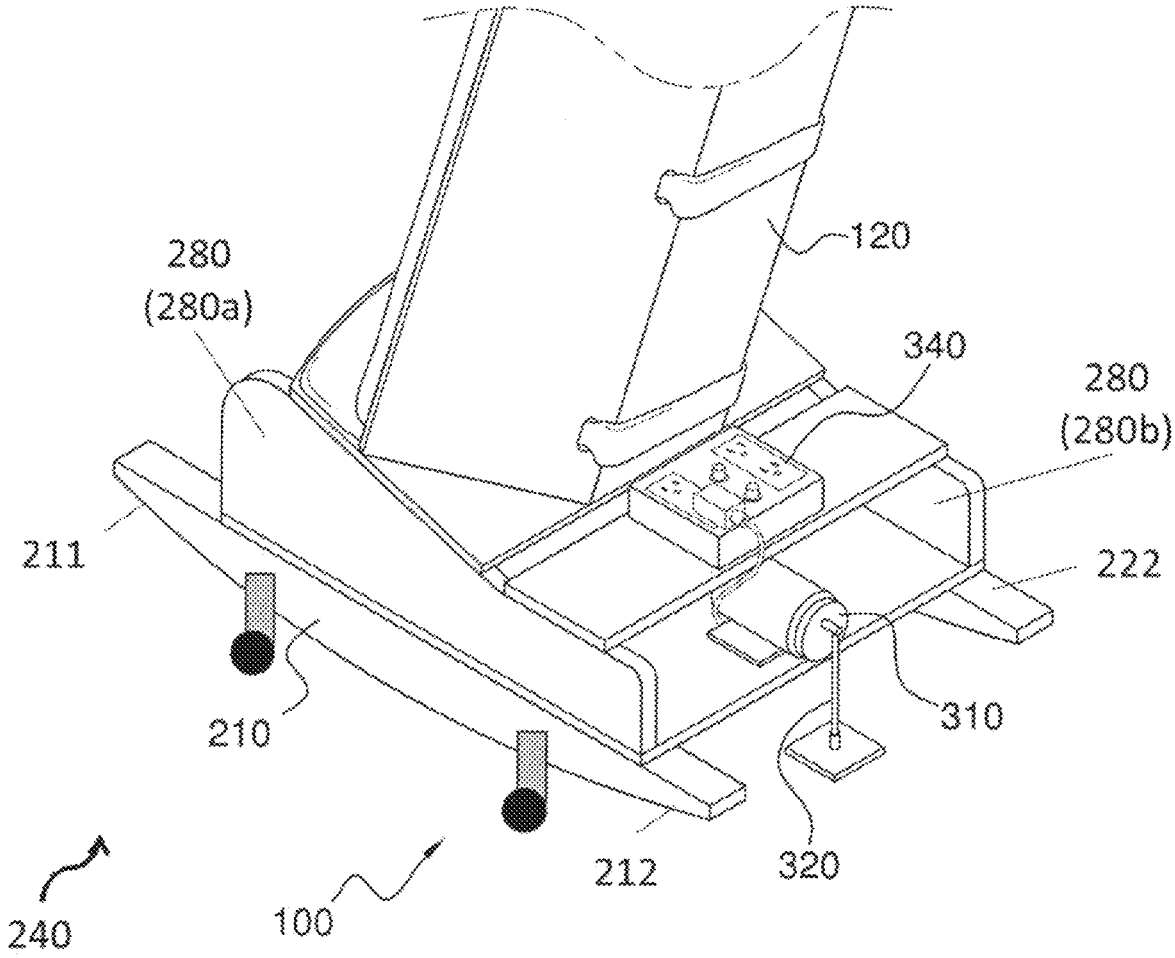
FIG. 8B is a back perspective view of the system of the present invention, wherein the wheels are lowered to allow movement of the system via the wheels.
Figure 9A:
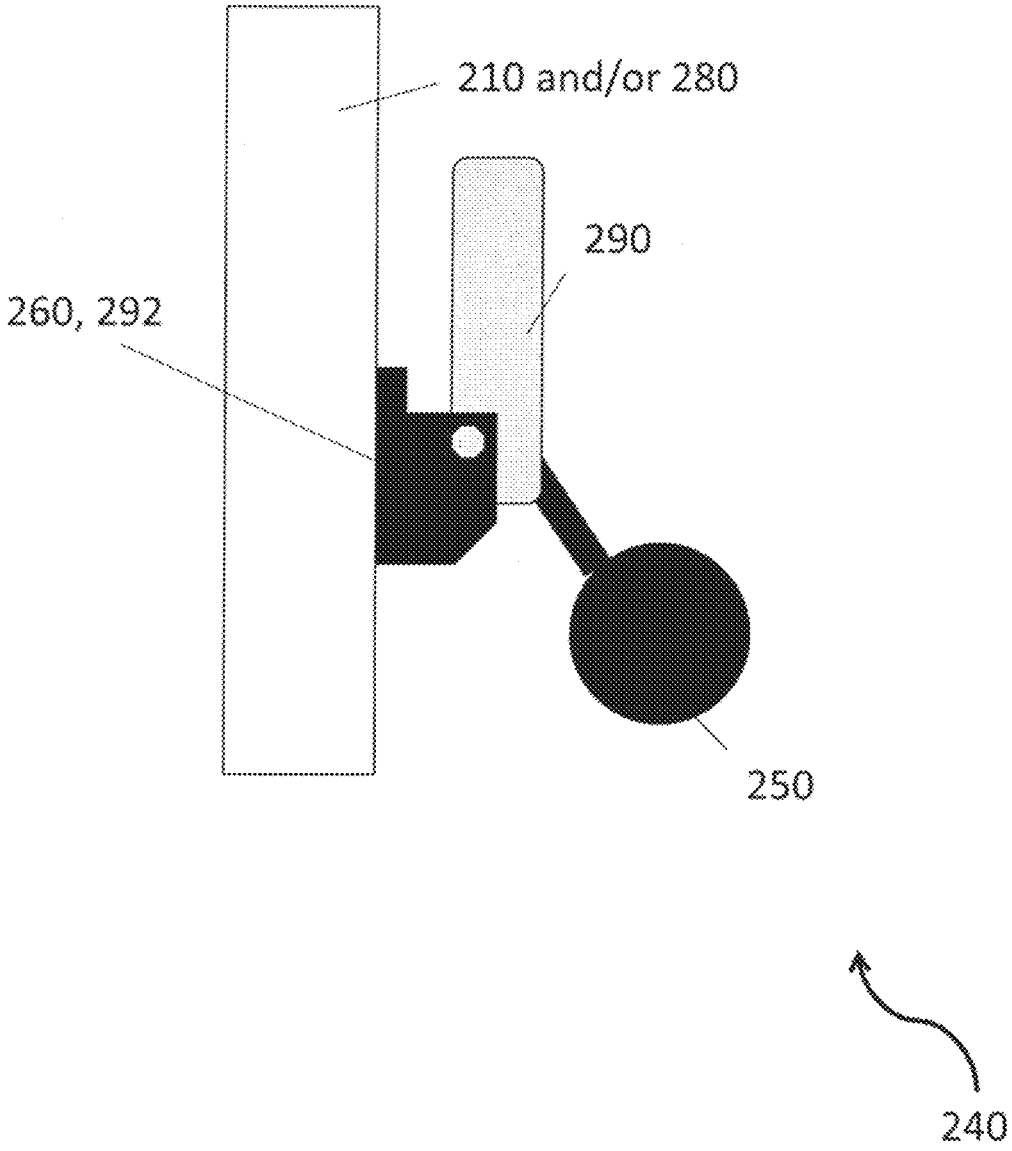
FIG. 9A is a detailed view of the system of the present invention, wherein the wheels are raised so as to prevent movement of the system via the wheels.
Figure 9B:
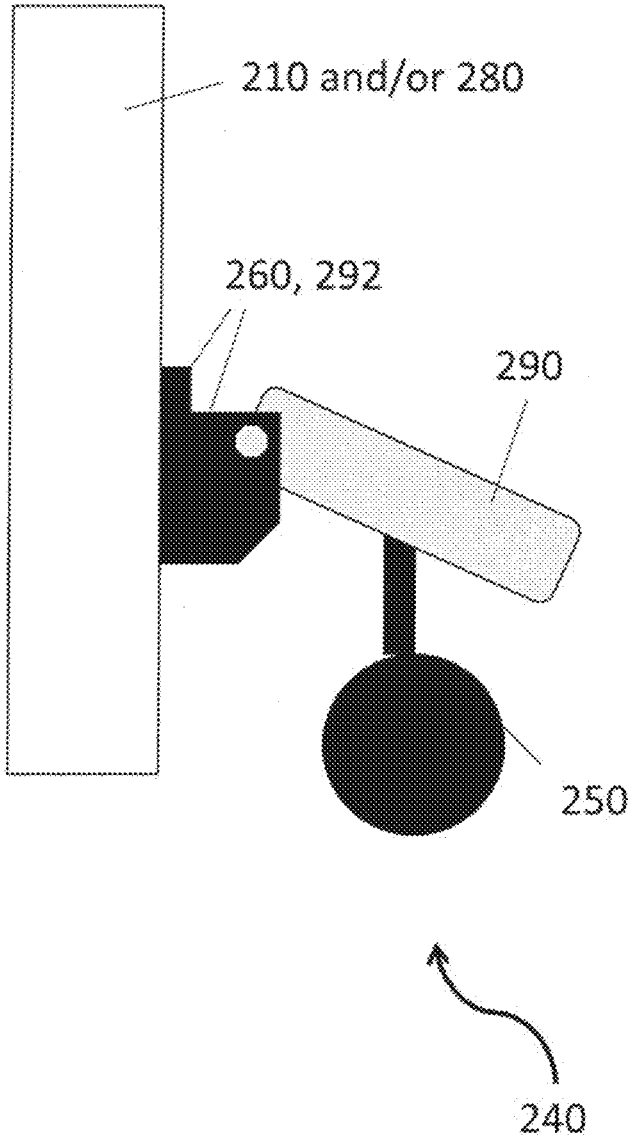
FIG. 9B is a detailed view of the system of the present invention, wherein the wheels are lowered to allow movement of the system via the wheels.

In some embodiments, the wheels (250) can be locked, for example to prevent movement of the chair once it is in a proper place. Various locking mechanisms may be employed. In some embodiments, the wheels (250) can be lifted and lowered as needed. For example, the wheels (250) may be lowered (as shown in FIG. 8B and FIG. 98) to contact the ground surface when the system (100) is to be moved, or the wheels (250) may be raised off the ground surface (as shown in FIG. 8A and FIG. 9A) if the system (100) is to be immobilized. FIG. 9A and FIG. 9B show a detailed view of an example of a lockable wheel. The wheel (250) is connected to a pedal (290), which is pivotally attached to a pivot bracket (292) disposed on the rocker (210, 220) and/or chair base (280).

In some embodiments, one or more components of the system (100) may be constructed from a material comprising wood. In some embodiments, one or more components of the system (100) comprises padding, e.g., latex-free padding. The size of the system (100) may vary, for example to accommodate a wide range of children and adults with special needs. In some embodiments, one or more components of the chair component (105), e.g., the seat portion (110), is constructed from a soft material, e.g., a latex-free material. In some embodiments, one or more components of the chair component (105), e.g., the seat portion (110), is constructed from a material comprising an anti-microbial material.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A motorized chair system (100) comprising:

(a) a chair component (105) comprising a back support portion (120) disposed atop a seat portion (110), the back support portion (120) is formed from a first side panel (111), a middle panel (113), and a second side panel (112) connected together wherein the middle panel (113) is sandwiched between the first side panel (111) and the second side panel (112), wherein a first rigid intersection (114) is formed between the first side panel (111) and the middle panel (113) and a second rigid intersection (115) is formed between the second side panel (112) and the middle panel (113);

(b) a leg divider shaft (130) disposed on the seat portion (110) near or at a front surface (118), the leg divider shaft (130) functions to separate a user's legs when seated atop the seat portion (110);

(c) a rocking component (205), the chair component (105) is mounted atop the rocking component (205), the rocking component (205) is shaped to allow the chair component to rock forwardly and backwardly;

(d) a wheel system (240) disposed on the rocking component (250) to allow transport of the system (100);

(e) a motor system (310) disposed on the rocking component (205) and operatively connected to a piston (320), the piston (320) being mounted to a ground surface, the motor system (310) functions to automatically rock the chair component (105) forwardly and backwardly by pushing against the piston (320) to pivot the system (100) in a forward motion; and (f) a control button (380) operatively connected to the motor system (310), the control button (380) functions to turn the motor system (310) on and off, the control button (380) is mounted to the back support portion via a temporary attachment means (382), the temporary attachment means (382) allowing a user to choose a position of the control button (380).

2. The system (100) of claim 1, wherein the first side panel (111), the middle panel (113), and the second side panel (112) are each flat panels.

3. The system (100) of claim 1, wherein a first angle (301) is formed between the first side panel (111) and the middle panel (113), wherein the first angle (301) is between about 90 to 179 degrees.

4. The system (100) of claim 1, wherein a second angle (302) is formed between the first side panel (111) and the middle panel (113), wherein the second angle (302) is between about 90 to 179 degrees.

5. The system (100) of claim 1, wherein the rocking component (205) comprises a first rocker (210) disposed on a first side and a second rocker (220) disposed on a second side.

6. The system (100) of claim 1, wherein the motor system (310) is operatively connected to a control box (340), the control box (340) allows for manipulation of rocking speed, manipulation of frequency of rocking, or both manipulation of rocking speed and manipulation of frequency of rocking.

7. The system (100) of claim 6, wherein the control button (380) is operatively connected to the control box (340).

8. The system (100) of claim 1, wherein the wheel system (240) comprises (a) a first wheel (250*a*) disposed on the rocking component (205) at or near a front end (211) of the first rocker (210) or at or near a front end of a first base side (280*a*) of a chair base (280); (b) a second wheel (250*b*) disposed on the rocking component (205) at or near a back end (212) of the first rocker (210) or at or near a back end of the first base side (280*a*) of the chair base (280); (c) a third wheel disposed on the rocking component (205) at or near a front end (221) of the second rocker (220) or at or near a front end of a second base side (280*b*) of the chair base (280); and (d) a fourth wheel disposed on the rocking component (205) at or near a back end (222) of the second rocker (220) or at or near a back end of the second base side (280*b*) of the chair base (280).

9. The system (100) of claim 8, wherein the wheels (250) are attached via mounting brackets (260).

10. The system (100) of claim 8, wherein the wheels (250) can be locked to temporarily prevent transport of the system (100).

11. The system (100) of claim 10, wherein the wheels (250) can be lowered to contact a ground surface when the system (100) is to be moved, and the wheels (250) can be raised off the ground surface when the system (100) is to be immobilized.

12. The system (100) of claim 11, wherein each wheel (250) is connected to a pedal (290), the pedal (290) is pivotally attached to a pivot bracket (292) disposed on the rocking component (205).

13. The system (100) of claim 1, wherein wheels (250) of the wheel system (240) can be locked to temporarily prevent transport of the system (100).

14. The system (100) of claim 1 further comprising straps (140) disposed on the chair component (105) for securing the user in the chair component (105).

15. The system (100) of claim 1 further comprising a footrest (150) disposed on the rocking component (205) below the seat portion (110) of the chair component (105).

* * * * *